US009689270B2

(12) United States Patent
Pillhoefer et al.

(10) Patent No.: US 9,689,270 B2
(45) Date of Patent: Jun. 27, 2017

(54) DUPLEX-PHASE CRAL COATING FOR IMPROVED CORROSION/OXIDATION PROTECTION

(71) Applicant: MTU AERO ENGINES AG, Munich (DE)

(72) Inventors: Horst Pillhoefer, Roehrmoos (DE); Stefan Mueller, Munich (DE); Erwin Bayer, Dachau (DE); Thomas Dautl, Weichs (DE)

(73) Assignee: MTU AERO ENGINES AG, Munich (DE)

( * ) Notice: Subject to any disclaimer, the term of this patent is extended or adjusted under 35 U.S.C. 154(b) by 658 days.

(21) Appl. No.: 13/961,965

(22) Filed: Aug. 8, 2013

(65) Prior Publication Data

US 2014/0044986 A1 Feb. 13, 2014

(30) Foreign Application Priority Data

Aug. 8, 2012 (DE) ..... 10 2012 015 586

(51) Int. Cl.
*F01D 5/28* (2006.01)
*C23C 10/20* (2006.01)
*C23C 10/60* (2006.01)

(52) U.S. Cl.
CPC ..... *F01D 5/288* (2013.01); *C23C 10/20* (2013.01); *C23C 10/60* (2013.01); *Y10T 428/12639* (2015.01)

(58) Field of Classification Search
None
See application file for complete search history.

(56) References Cited

U.S. PATENT DOCUMENTS 4,371,312 A * 2/1983 Tank ..... 415/200
5,725,905 A * 3/1998 Walter et al. ..... 427/156
7,229,701 B2 6/2007 Madhava et al.
7,824,738 B2 11/2010 Smith et al.
8,916,005 B2 12/2014 Cavanaugh et al.
9,222,163 B2 12/2015 Box et al.
(Continued)

FOREIGN PATENT DOCUMENTS

DE 102008039969 A1 3/2010
EP 0587341 B1 3/1996
(Continued)

OTHER PUBLICATIONS

Introductory University Chemistry, unknown auther, downloaded Jul. 2014. Evidentiary.*
(Continued)

*Primary Examiner* — Joseph Miller, Jr.
(74) *Attorney, Agent, or Firm* — Abel Law Group, LLP

(57) ABSTRACT

Disclosed is a coating for protecting a component against high temperatures and aggressive media, which coating has at least one subregion whose main constituent is chromium. The layer additionally comprises aluminum, the chromium content at least in the subregion in which chromium is the main constituent being greater than 30% by weight and the aluminum content being greater than or equal to 5% by weight. The invention further provides a process for producing such a coating, comprising chromizing the surface to be coated and subsequently alitizing the chromium-rich layer produced during chromizing.

20 Claims, 5 Drawing Sheets

(56) References Cited

U.S. PATENT DOCUMENTS

| | | | | |
|---|---|---|---|---|
| 2003/0111140 | A1* | 6/2003 | Wydra | 148/527 |
| 2003/0118448 | A1* | 6/2003 | Lee et al. | 416/241 R |
| 2006/0046091 | A1 | 3/2006 | Madhava et al. | |
| 2007/0184305 | A1* | 8/2007 | Madhava et al. | 428/697 |
| 2007/0187005 | A1* | 8/2007 | Taylor | 148/428 |
| 2008/0057189 | A1 | 3/2008 | Smith et al. | |
| 2009/0126833 | A1 | 5/2009 | Cavanaugh et al. | |
| 2010/0136240 | A1 | 6/2010 | O'Connell | |
| 2013/0040166 | A1 | 2/2013 | Box et al. | |

FOREIGN PATENT DOCUMENTS

| | | | |
|---|---|---|---|
| EP | 2060653 | A2 | 5/2009 |
| WO | 2005106064 | A1 | 11/2005 |
| WO | 2006026456 | A1 | 3/2006 |
| WO | 2010138096 | A1 | 12/2010 |

OTHER PUBLICATIONS

"Finagle Factor" reference, Wikipedia; downloaded Aug. 2014. Argumentative/evidenciary reference for interpretative purposes.*

* cited by examiner

DUPLEX-PHASE CRAL COATING FOR IMPROVED CORROSION/OXIDATION PROTECTION

CROSS-REFERENCE TO RELATED APPLICATIONS

The present application claims priority under 35 U.S.C. §119 of German Patent Application No. 10 2012 015 586.7, filed Aug. 8, 2012, the entire disclosure of which is expressly incorporated by reference herein.

BACKGROUND OF THE INVENTION

1. Field of the Invention

The present invention relates to a coating for components which are exposed to high temperatures and aggressive media, e.g. components of gas turbines and in particular aircraft engines. In addition, the present invention relates to a process for producing such coatings and also components produced in this way.

2. Discussion of Background Information

The addition of chromium and/or aluminum as alloying constituents to alloys in order to effect corrosion and/or oxidation protection in the high-temperature range for the materials alloyed therewith is known from the prior art. The addition of chromium and/or aluminum results in formation of frequently slow-growing chromium oxide or aluminum oxide layers under corrosive and oxidizing conditions of this type, and these oxide layers can protect the material against further attack. Depending on the composition of the material to be protected and the specific use conditions, either chromium or chromium-rich layers or aluminum or aluminum-rich layers are employed.

In addition, the formation of corrosion protection layers and/or high-temperature oxidation protection layers which can likewise contain chromium and/or aluminum is also known in many different applications.

Furthermore, it should be noted that such protective layers also have to have mechanical properties which avoid damage or destruction of the protective layers under the given use conditions, since mechanical damage to the layers can once again lead to increased corrosive attack or oxidative attack. Accordingly, many coatings having proportions of chromium and/or aluminum are known in the prior art. An example is given in WO 2006/026456, the entire disclose of which is incorporated by reference herein, in which chromium layers which have a chromium content of 30% and additionally comprise aluminum are described. A further example is described in DE 10 2008 039 969 A1, the entire disclose of which is incorporated by reference herein, which discloses chromium layers having a chromium content of more than 30% by weight.

In the case of gas turbines and in particular aircraft engines, components which are operated in environments at which both high temperatures and also aggressive media occur are used. Thus, aircraft are operated, for example, above the sea or close to the sea and salt-containing air and accordingly also salt particles can therefore be introduced into the engines. In addition, further elements such as sulfur, sodium, calcium and potassium which can bring about corrosion can be present due to the fuel. Since the engines also have high operating temperatures during operation, severe high-temperature oxidative conditions also prevail. As a consequence, components of this type, for example turbine blades in the low-pressure turbine of an aircraft engine, have to withstand high temperatures and also be protected against corrosion, e.g. sulfidation. However, the coatings known hitherto do not give a satisfactory result here.

It is therefore desirable to have available a coating which protects against high-temperature oxidation and corrosion for components which are exposed to high temperatures and corrosion, in particular components of gas turbines and aircraft engines. In addition, a process for corresponding coating of components, which is simple to carry out and allows reliable coating and offers high-temperature oxidation protection and corrosion protection to components subject to such stress is desirable. It further is desirable to have available components of this type, e.g. turbine blades of aircraft engines and in particular low-pressure turbine blades.

SUMMARY OF THE INVENTION

The present invention provides a coating for protecting a metallic component against high temperatures and aggressive media. The component is formed by an alloy having a metallic main constituent which makes up the largest proportion of the alloy. The coating comprises chromium and aluminum and has an outer zone and an inner zone, the outer zone comprising α-chromium phases in a matrix of a mixture of mixed crystals essentially comprising the constituents of the metallic main constituent of the component, aluminum and chromium, and the inner zone comprising a mixed crystal zone essentially comprising the constituents of the metallic main constituent of the component, aluminum and chromium. The proportion of chromium in the total coating is greater than 30% by weight and the aluminum content in the total coating is greater than or equal to 5% by weight.

In one aspect of the coating, the proportion of chromium in the outer zone may be from 30% by weight to 95% by weight of chromium, e.g., from 50% by weight to 70% by weight of chromium and/or the proportion of chromium in the α-chromium phases may be greater than or equal to 70% by weight, e.g., greater than or equal to 80% by weight.

In another aspect of the coating, the proportion of aluminum in the outer zone may be from 10% to 40% by weight, e.g., from 15% to 30% by weight, in particular from 20% to 25% by weight, of aluminum and/or the proportion of the constituent of the main constituent may be less than or equal to 40% by weight, e.g., less than or equal to 30% by weight.

In yet another aspect of the coating of the present invention, in the inner zone the proportion of chromium may be less than or equal to 30% by weight, the proportion of aluminum may be less than or equal to 30% by weight, and the proportion of the main constituent may be greater than or equal to 30% by weight.

In yet another aspect of the coating, the proportion of chromium across the total coating may be from 30% by weight to 90% by weight of chromium, e.g., from 40% by weight to 60% by weight of chromium, and/or the proportion of aluminum across the total coating may be from 10% to 40% by weight, e.g., from 15% to 30% by weight, in particular from 20% to 25% by weight.

In a still further aspect, the outer zone of the coating may make up a proportion of greater than or equal to 50% of the total coating.

In another aspect of the coating, the α-chromium phases may be present as globulitic or ellipsoidal grains, e.g., having an average diameter of from 2 μm to 40 μm, in particular having a proportion by volume of from 10% to 90%.

In another aspect, the coating may have up to 10% by volume of pores having average diameters of from 2 μm to 20 μm.

In another aspect, the coating may comprise from 1% to 15% by weight of oxides, in particular oxides having average grain diameters of from 2 μm to 20 μm.

In yet another aspect, the coating may comprise constituents of the base material of the component to be coated and/or the main constituent may be nickel, iron and/or cobalt.

The present invention also provides a process for producing a coating for protecting a component against high temperatures and aggressive media, in particular a coating of the present invention as set forth above (including the various aspects thereof). The process comprises chromizing a surface to be coated and subsequently alitizing a chromium-rich layer produced during chromizing. The chromizing is carried out with a chemical chromium activity of greater than or equal to 0.4.

In one aspect of the process, the chromizing may be carried out by using a Cr-rich slip containing a liquid phase. The slip may, for example, be applied by injection molding.

In another aspect of the process, the chromizing may be carried out in such a way that a chromium-rich layer having an outer α-chromium sublayer and an inner mixed crystal layer essentially composed of chromium and the main constituent which forms the major part of the alloy of the coated component is formed. For example, the chromium content of the chromium-rich layer may be greater than or equal to 40% by weight.

In yet another aspect of the process, the chromizing may be carried out at a temperature of from 1020° C. to 1180° C., e.g., from 1080° C. to 1140° C., for a period of from 2 to 20 hours, e.g., from 10 to 15 hours, and/or the alitizing may be carried out at a temperature of from 1050° C. to 1150° C., e.g., from 1080° C. to 1100° C., for a period of from 3 to 20 hours, e.g., from 9 to 15 hours.

In a still further aspect of the process of the present invention, the chemical aluminum activity during alitizing may be greater than or equal to 0.3.

In another aspect of the process, a first alitizing may be followed by a second alitizing at a lower chemical aluminum activity, e.g., at a chemical aluminum activity of from 0.05 to 0.3, at a temperature of greater than or equal to 1050° C. for a period of from 3 to 20 hours.

In yet another aspect, the chromizing and alitizing may be followed by a diffusion heat treatment at a temperature of greater than or equal to 1050° C. for a period of from 2 to 8 hours.

In another aspect of the process, a surface treatment by PVD, CVD, surface coating, electrochemical deposition and/or direct application of a material, in which one or more elements from the group platinum, palladium, hafnium, zirconium, yttrium and silicon are applied, may be carried out before, during or after chromizing and/or alitizing.

The present invention also provides a coating that is produced by the process of the present invention as set forth above (including the various aspects thereof), as well as a component of a gas turbine, in particular of an aircraft engine, which comprises the coating of the present invention and/or a coating which is produced by the process of the present invention.

The present invention is based on the idea that an improved corrosion protection effect combined with sufficient oxidation protection can be achieved when a layer system having a very high chromium content and at the same time an increased aluminum content is produced. The coating can be produced by means of a two-stage process in which a chromium-rich layer is firstly produced by chromium diffusion in order to subsequently generate a significant proportion of aluminum in the layer by alitizing.

The coating system and the process are preferably used in components for gas turbines or aircraft engines, with such components preferably being able to consist of nickel-based alloys so that a proportion of the layer system produced is formed by constituents of the base material, i.e., in particular, nickel as the main component having the greatest proportion in the alloy. Apart from nickel-based alloys, iron- or cobalt-based alloys are also possible, so that the coating can also have corresponding proportions of iron and/or cobalt.

However, the proportion of nickel, iron and/or cobalt at the component surface is kept low by means of a high proportion of Cr and a likewise high proportion of Al in the coating, so that corrosive attack, e.g. sulfidation, can be avoided. For this purpose, the proportion of nickel, iron and/or cobalt, particularly in an outer zone adjacent to the surface, can be reduced to a proportion of less than or equal to 60% by weight, in particular less than or equal to 30% by weight. The coating comprises an outer zone and an inner zone. The outer zone of the coating has two phases. The at least two-phase or bimodal microstructure comprises a chromium-rich α phase which is embedded in a matrix composed of the main constituent of the alloy of the coated component, chromium and aluminum, while the inner zone is a mixed crystal zone having the same constituents.

The coating can preferably have more than 30% by weight of chromium, in particular from 35% by weight to 90% by weight of chromium, preferably from 40% by weight to 60% by weight of chromium, over the entire coating. In an outer zone of the coating, in which α-chromium phases are present in a matrix of mixed crystals comprising essentially the main constituent of the coated component, aluminum and chromium, the chromium content is higher and can be in the range from 40% by weight to 95% by weight of chromium, preferably from 50% by weight to 70% by weight of chromium, with the chromium contents of the α-chromium phases being able to be greater than or equal to 70% by weight, preferably greater than or equal to 80% by weight.

The proportion of aluminum in the outer zone and/or over the entire coating can be in the range from 10% to 40% by weight, preferably from 15% to 30% by weight, in particular from 20% to 25% by weight, of aluminum.

The respective balance is formed by constituents of the base material into which the layer has at least partially grown by inward diffusion and/or which have diffused into the coating. In the case of nickel-based alloys which can be used in gas turbine construction and in aircraft engines for temperature-stressed components, mainly nickel-containing phase constituents, for example aluminum-nickel-chromium phases, are present in the layer system. In particular, the matrix of the outer zone and/or the inner mixed crystal zone can comprise a mixture of mixed crystals formed by the main constituent of the alloy of the coated component and/or aluminum and/or chromium; for example in the case of a nickel-based alloy $Al_xNi_y$, AlNi, $Al_3Ni_2$, $Al_3Ni$ or $Cr_2Al$.

The outer zone can make up a proportion of greater than or equal to 50% of the total coating.

The α-chromium phases can be present as globulitic or ellipsoidal grains and have a proportion by volume in the outer zone of from 10% to 90% by volume. The average grain diameter, i.e. in the case of a noncircular shape, for example, the mean of minimum and maximum diameter, can be in the range from 2 μm to 40 μm.

The coating may comprise oxides, which may have an average grain diameter of from 2 μm to 20 μm, in a proportion of from 1% by weight to 15% by weight. The layer thickness of the coating can be in the range from 20 μm to 150 μm.

The chromizing step in the two-stage process for producing layers having a high chromium content and a high proportion of aluminum may be carried out by chromium diffusion processes such as powder pack processes or gas-phase chromium diffusion, with the chemical chromium activity being greater than or equal to 0.4.

The chromizing may, in particular, be generated by a heat treatment in the presence of a chromium powder pack and a halide-containing atmosphere, with the powder pack being able to comprise activators and binders. Possible binders include alcohols or other solvents, while halides may be used as activator. When using a chromium powder pack having chromium activities (chemical activity) of more than 0.4 or 40%, respectively, a chromium-rich layer having a layer thickness of from 10 μm to 150 μm and a chromium content of greater than or equal to 40% by weight, in particular from 50% by weight to 95% by weight, may be formed during aging in a temperature range from 1050° C. to 1180° C., in particular from 1090° C. to 1100° C., for times of from 2 to 20 hours, in particular from 10 to 15 hours. The chromium-rich layer has an outer α-chromium sublayer and an inner mixed crystal layer comprising essentially chromium and the main constituent of the alloy of the coated component, e.g. nickel.

Following the production of the chromium-rich layer, the base material which has been treated in this way, for example a component of a gas turbine or of an aircraft engine, is subjected to an alitizing process (also referred to as gas-phase alitizing) in which the component is, for example, packed in a powder packing having a high aluminum activity (chemical activity) in the range of greater than or equal to 0.3 or 30%, respectively, and aged at temperatures in the range from 1050° C. to 1150° C., preferably from 1080° C. to 1100° C., for from 3 to 20 hours, in particular from 9 to 15 hours. Possible powder packings include mixtures of aluminum oxide powder, aluminum powder and a halide as activator, so that aluminum can diffuse in an amount in the order of from 10% by weight to 30% by weight into the layer.

After alitizing with a chemical aluminum activity of greater than or equal to 0.3 or 30%, respectively, a second alitizing step may be carried out at a lower chemical aluminum activity, where the aluminum activity can be selected in the range from 0.05 to 0.3. The aging temperature in this second alitizing step may be greater than or equal to 1050° C. and the aging time may be from 3 to 20 hours.

In addition, the chromizing and alitizing may be followed by a diffusion heat treatment at a temperature greater than or equal to 1050° C. for a time of from 2 to 8 hours.

Before, during or after chromizing and/or alitizing, a surface treatment in which one or more elements from the group platinum, palladium, hafnium, zirconium, yttrium and silicon are applied by physical vapor deposition (PVD), chemical vapor deposition (CVD), surface coating, electrodeposition and/or direct application of a material may be carried out. In this way, one or more of these elements can be introduced into the layer in order to exert an additional positive influence on the properties of the layer.

BRIEF DESCRIPTION OF THE DRAWINGS

The attached drawings show in

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show details of the present invention in more detail than is necessary for the fundamental understanding of the present invention, the description in combination with the drawings making apparent to those of skill in the art how the several forms of the present invention may be embodied in practice.

Figure 1:
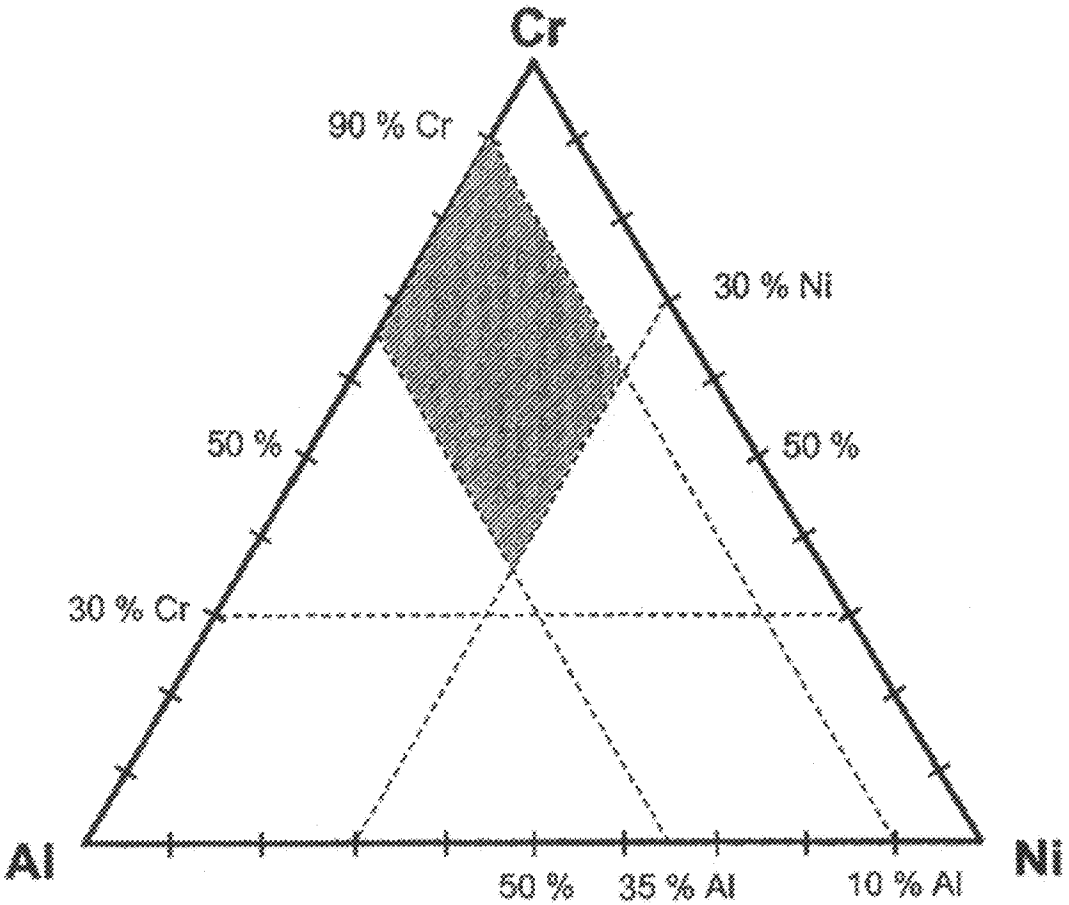
FIG. 1 a diagram indicating the composition of the coating produced for the example of a chromium-aluminum coating on a nickel-based alloy.

FIG. 1 shows a ternary phase diagram in which the region of the composition to which the coating which has been applied according to the present invention to a nickel-based material is to be assigned is made clear. The hatched field shows the region of the composition which the coating according to the invention can have. Here, there is a high chromium content of more than 30% by weight of chromium, in particular in the range from 30% to 90% by weight of chromium, and a moderate aluminum content of from 10% to 35% by weight of aluminum. The proportion of the base material or of the main constituent thereof is below 30% by weight, i.e. in the present case below 30% by weight of nickel.

Figure 2:
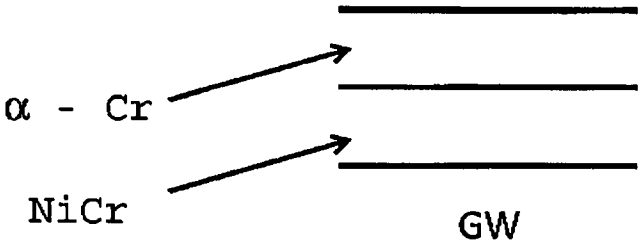
FIG. 2 a depiction of a coating as is present after the chromizing step.

FIG. 2 shows the formation of a chromium-rich layer after high-activity chromizing; here, an outer α-chromium-nickel sublayer and a chromium-containing mixed crystal sublayer have been formed. The mixed crystal sublayer is formed by mixed crystals of chromium and the main constituent of the base material, i.e., for example, NiCr in the case of application to nickel-based alloys. The chromium-rich layer of the α-chromium-nickel sublayer and the mixed crystal layer has a chromium content of greater than or equal to 40% by weight. Both in the outer layer and in the inner layer, nickel, elements of the base material and/or deliberately introduced platinum and palladium, silicon, hafnium, yttrium and/or zirconium can be present.

Figure 3:
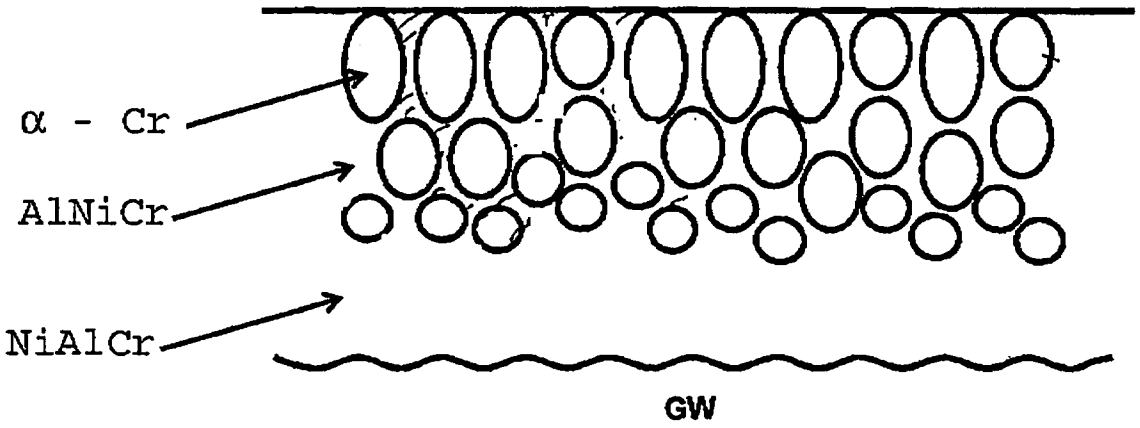
FIG. 3 a depiction of a coating as is present in the finished state.

The component bearing a correspondingly configured intermediate layer is subjected in a second step to an alitizing step in which aluminum diffuses into the intermediate layer so as to form an AlNiCr matrix in which α-chromium phases are incorporated in an outer zone, as shown in FIG. 3. The α-chromium phases can have a Cr content of more than 40% by weight, with the balance being essentially nickel. The outer zone having the bimodal microstructure makes up a proportion of more than 60% of the total layer thickness. The inner zone comprises only an NiAlCr mixed crystal having a composition of more than 30% by weight of nickel, less than 40% by weight of Cr and less than 30% by weight of Al. The α-chromium phase has a proportion by volume in the bimodal microstructure of 10-90% and in the precipitated form is globulitic and ellipsoidal having a diameter of from 1 to 40 μm. The AlCrNi phase correspondingly has a proportion by volume of 90% in the bimodal microstructure.

The AlNiCr matrix of the outer zone comprises, in particular, $Al_xNi_y$, AlNi, $Al_3Ni_2$, $Al_3Ni$ and $Cr_2Al$ phases, while essentially NiAl mixed crystals having proportions of chromium are present in the NiAlCr mixed crystal zone of the inner zone.

The α-chromium phase of the outer zone has chromium contents of greater than or equal to 70% by weight of chromium, with essentially nickel being additionally dissolved in the α-chromium phases. The total layer has a chemical composition of from 30% to 90% by weight of chromium, from 10% to 35% by weight of aluminum, up to 60% by weight of nickel, proportions of up to 25% by weight of platinum, palladium, up to 15% by weight of silicon, up to 15% by weight of hafnium, zirconium. The total layer thickness can be from 20 to 150 μm.

Figure 4:
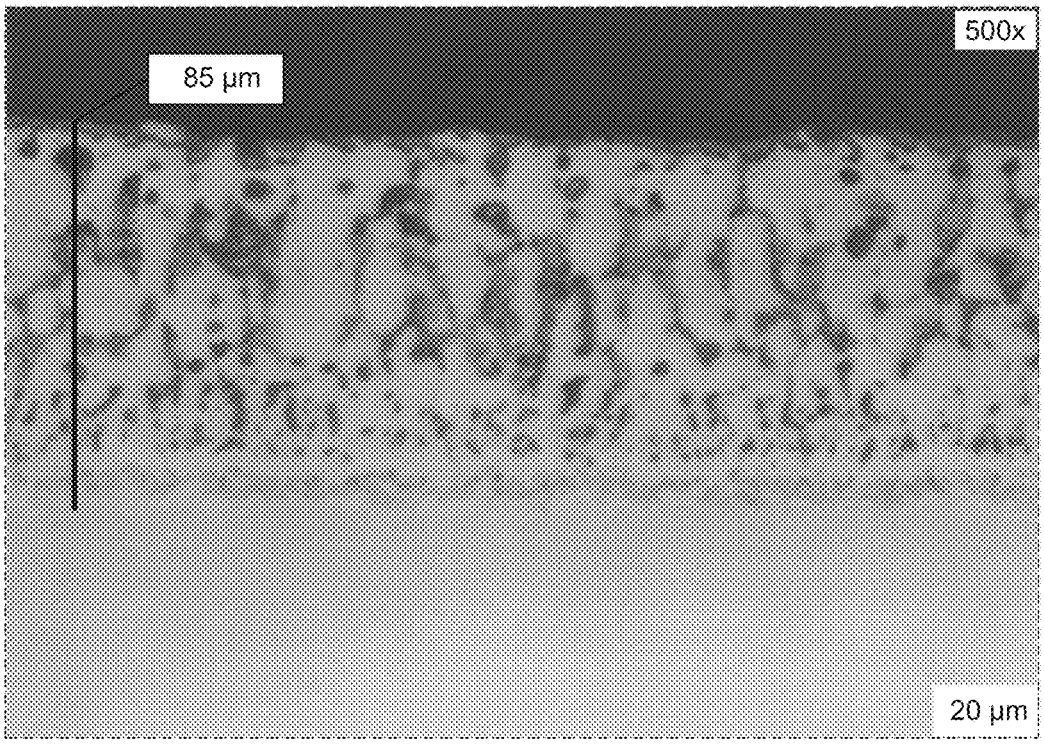
FIG. 4 a magnification of a transverse microsection of an exemplary coating layer according to the present invention.
Figure 5:
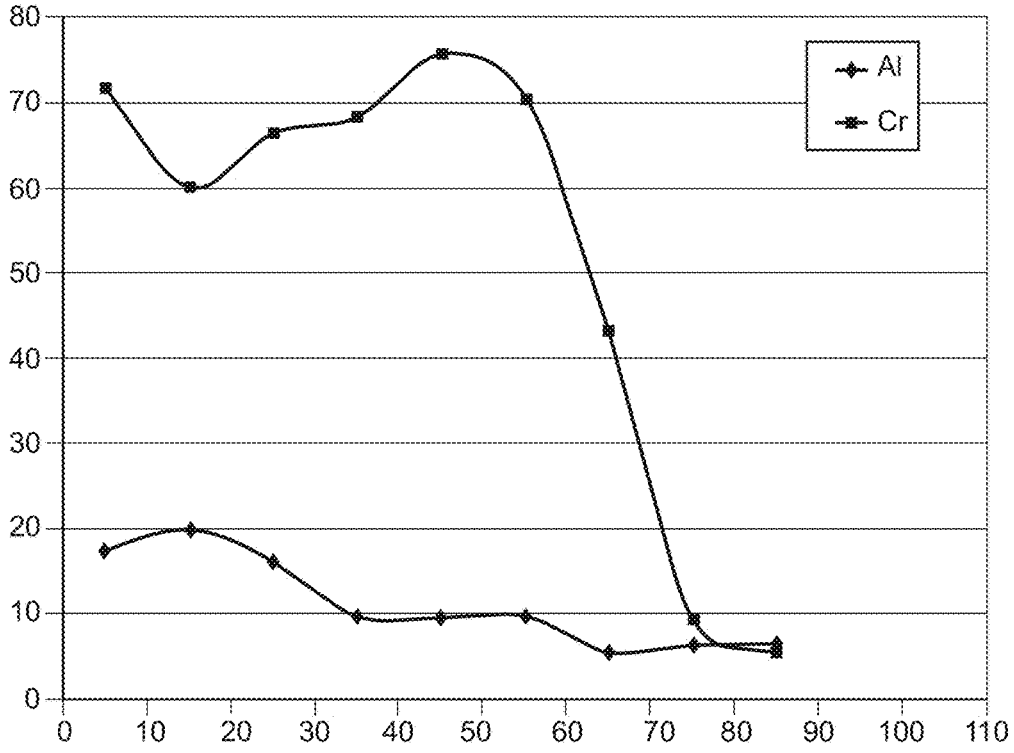
FIG. 5 the distribution of Al and Cr along the depth direction in the coating layer shown in FIG. 4.

FIG. 4 shows a magnification of a transverse microsection of an exemplary coating layer according to the present invention. More specifically, FIG. 4 shows a bimodal microstructure of chromium rich alpha-phases embedded in an AlNiCr-matrix (substantially corresponding to the diagrammatic illustration of FIG. 3). The layer shown in FIG. 4 has a depth of 85 micrometer and exhibits along the depth direction a distribution of aluminum and chromium as shown in the diagram of FIG. 5 (the x-axis of FIG. 5 refers to the depth in micrometer, and the y-axis of FIG. 5 refers to the weight percentage of Al and Cr in the layer). As can be seen in the diagram of FIG. 5, between the upper surface of the layer and a depth of about 60 micrometer the content of chromium is between 60 wt-% and 78 wt-% and the content of aluminum is between 10 wt-% and 20 wt-%. Thereafter, the content of chromium significantly lowers.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A process for producing a coating for protecting a component against high temperatures and aggressive media, the component being formed by an alloy having one or more metallic main constituents which make up the largest proportion of the alloy, wherein the process comprises chromizing a surface to be coated and subsequently aluminizing a chromium-rich layer produced during chromizing, the chromizing being carried out with a chemical chromium activity of at least 0.4, and wherein the process affords a coating that has an outer zone and an inner zone, the outer zone comprising α-chromium phases in a matrix of a mixture of mixed crystals comprising essentially chromium, aluminum, and the one or more metallic main constituents of the alloy, and the inner zone comprising a mixed crystal zone comprising essentially chromium, aluminum, and the one or more metallic main constituents of the alloy, the proportion of chromium in a total coating being greater than 30% by weight and a proportion of aluminum in a total coating being at least 5% by weight, and wherein at least one of:

(i) a proportion of chromium in the outer zone is from 30% by weight to 95% by weight of chromium;
(ii) a proportion of chromium in the α-chromium phases is at least 70% by weight;
(iii) a proportion of aluminum in the outer zone is from 10% to 40% by weight of aluminum;
(iv) the one or more metallic main constituents in the outer zone are present in a proportion of not higher than 40% by weight;
(v) in the inner zone a proportion of chromium is not higher than 30% by weight, a proportion of aluminum is not higher than 30% by weight, and a proportion of the one or more main constituents is at least 30% by weight;
(vi) a proportion of chromium in the total coating is from greater than 30% by weight to 90% by weight;
(vii) a proportion of aluminum in the total coating is from 10% to 40% by weight;
(viii) the outer zone of the coating makes up a proportion of at least 50% of the total coating;
(ix) the coating has up to 10% by volume of pores having average diameters of from 2 μm to 20 μm;
(x) the coating comprises from 1% to 15% by weight of oxides;
(xi) the one or more metallic main constituents of the alloy are one or more of nickel, iron and cobalt;
(xii) the chromizing is carried out using a Cr-rich slip containing a liquid phase.

2. The process of claim 1, wherein the chromizing is carried out using a Cr-rich slip containing a liquid phase.

3. The process of claim 2, wherein the slip is applied by injection molding.

4. The process of claim 1, wherein the chromizing is carried out at a temperature of from 1020° C. to 1180° C. for a period of from 2 to 20 hours.

5. The process of claim 1, wherein the aluminizing is carried out at a temperature of from 1050° C. to 1150° C. for a period of from 3 to 20 hours.

6. The process of claim 1, wherein the chemical aluminum activity during aluminizing is at least 0.3.

7. The process of claim 1, wherein a first aluminizing is followed by a second aluminizing at a lower chemical aluminum activity at a temperature of greater than or equal to 1050° C. for a period of from 3 to 20 hours.

8. The process of claim 1, wherein the chromizing and aluminizing are followed by a diffusion heat treatment at a temperature of greater than or equal to 1050° C. for a period of from 2 to 8 hours.

9. The process of claim 1, wherein a surface treatment by PVD, CVD, surface coating, electrochemical deposition and/or direct application of a material, in which one or more elements from the group platinum, palladium, hafnium, zirconium, yttrium and silicon are applied, is carried out before, during or after chromizing and/or aluminizing.

10. The process of claim 1, wherein a proportion of chromium in the outer zone is from 30% by weight to 95% by weight of chromium.

11. The process of claim 1, wherein a proportion of chromium in the α-chromium phases is at least 70% by weight.

12. The process of claim 1, wherein a proportion of aluminum in the outer zone is from 10% to 40% by weight of aluminum.

13. The process of claim 1, wherein the one or more metallic main constituents in the outer zone are present in a proportion of not higher than 40% by weight.

14. The process of claim 1, wherein in the inner zone a proportion of chromium is not higher than 30% by weight, a proportion of aluminum is not higher than 30% by weight, and a proportion of the one or more main constituents is at least 30% by weight.

15. The process of claim 1, wherein a proportion of chromium in the total coating is from greater than 30% by weight to 90% by weight.

16. The process of claim 5, wherein a proportion of aluminum in the total coating is from 10% to 40% by weight.

17. The process of claim 4, wherein the outer zone of the coating makes up a proportion of at least 50% of the total coating.

18. The process of claim 3, wherein the coating has up to 10% by volume of pores having average diameters of from 2 μm to 20 μm.

19. The process of claim 2, wherein the coating comprises from 1% to 15% by weight of oxides.

20. The process of claim 1, wherein the one or more metallic main constituents of the alloy are one or more of nickel, iron and cobalt.

* * * * *